US009494920B2

(12) United States Patent
Grize et al.

(10) Patent No.: US 9,494,920 B2
(45) **Date of Patent: *Nov. 15, 2016**

(54) FLUID INDICATOR

(71) Applicant: Preciflex SA, Biel/Bienne (CH)

(72) Inventors: Philippe-Emmanuel Grize, Neuchâtel (CH); Yves Berthier, Metabief (CH); Maurizio Minello, Bévilard (CH)

(73) Assignee: Preciflex SA, Biel/Bienne (CH)

( * ) Notice: Subject to any disclaimer, the term of this patent is extended or adjusted under 35 U.S.C. 154(b) by 218 days.

This patent is subject to a terminal disclaimer.

(21) Appl. No.: 14/083,538

(22) Filed: Nov. 19, 2013

(65) Prior Publication Data

US 2014/0160899 A1 Jun. 12, 2014

Related U.S. Application Data

(63) Continuation of application No. 13/422,438, filed on Mar. 16, 2012, now Pat. No. 8,593,911.

(30) Foreign Application Priority Data

Sep. 18, 2009 (CH) ..... 1446/09

(51) Int. Cl.

| | |
|---|---|
| ***G04B 1/26*** | (2006.01) |
| ***G04B 19/00*** | (2006.01) |
| ***G04B 39/00*** | (2006.01) |
| ***G04B 45/00*** | (2006.01) |

(52) U.S. Cl.

CPC ..... *G04B 19/00* (2013.01); *G04B 1/26* (2013.01); *G04B 39/00* (2013.01); *G04B 45/00* (2013.01); *Y10T 29/49236* (2015.01)

(58) Field of Classification Search

CPC ..... G04B 1/26

See application file for complete search history.

(56) References Cited

U.S. PATENT DOCUMENTS

| | | | | |
|---|---|---|---|---|
| 3,783,598 | A * | 1/1974 | Parr | 368/65 |
| 4,028,877 | A * | 6/1977 | Vatterott | 368/65 |
| 4,262,348 | A * | 4/1981 | Hess | 368/65 |
| 5,077,705 | A * | 12/1991 | Anderson | 368/19 |
| 6,116,774 | A * | 9/2000 | Sasaki et al. | 368/280 |
| 6,916,116 | B2 * | 7/2005 | Diekmann et al. | 374/102 |
| 7,245,561 | B2 * | 7/2007 | Coleman | 368/65 |
| 7,605,777 | B2 * | 10/2009 | Furetta | 345/34 |
| 7,616,528 | B2 * | 11/2009 | Meadows | 368/76 |
| 2008/0289710 | A1 * | 11/2008 | Unger et al. | 137/833 |
| 2009/0039000 | A1 * | 2/2009 | Zucchelli et al. | 210/91 |
| 2009/0165572 | A1 * | 7/2009 | Harish | 73/862.626 |

* cited by examiner

*Primary Examiner* — Amy Cohen Johnson
*Assistant Examiner* — Jason Collins
(74) *Attorney, Agent, or Firm* — Da Vinci Partners LLC; John Moetteli

(57) ABSTRACT

An indicator including a housing, a movement lodged in the housing, a watch glass above the housing, a fluid pump driven by the movement for pumping a fluid, and a channel. The channel is arranged so that the fluid circulated by the pump reaches the channel in order to fill the channel for displaying indications.

24 Claims, 3 Drawing Sheets

FLUID INDICATOR

The present application is a continuation of Ser. No. 13/422,438, continuation of international application PCT/EPI0/063567, filed on Sep. 15, 2009, the contents of which are hereby incorporated by reference. It claims priority of Swiss patent application CH09/01446 filed on Sep. 18, 2009, the contents of which is hereby incorporated by reference.

TECHNICAL FIELD

The present invention concerns a wristwatch, in particular a wristwatch in which at least some indications are displayed by means of a fluid.

STATE OF THE ART

In mechanical watches and docks, time indications are generally displayed by means of hands or rings driven in rotation behind an aperture.

There is however a constant need for alternate display forms to improve the legibility of certain indications or to challenge conventional aesthetic codes. For example, docks and clepsydras are known in which some indications are displayed by means of a colored fluid moving or filling alternatively graduated containers or pipes.

U.S. Pat. No. 4,034,554 describes for example a table dock with a display using liquids.

These solutions enable elegant or original docks to be made but are, however, difficult to transpose to a wristwatch. One of the difficulties arises from the absence of pumps with dimensions adapted to a wristwatch.

Another difficult arises from shocks and accelerations to which a wristwatch is subjected and which agitate the liquid. The mode of operation of most clepsydras and other clocks working with liquids depends on gravity and these devices can generally function only if they are immobile on a strictly horizontal surface; a liquid will spill or flow in an undesired direction as soon as the inclination is modified or the clock is subjected to shocks or accelerations.

WO 2005/069087 relates to a watch with a sandglass. It comprises a transparent internal case with two symmetrical containers containing sand, which are connected to one another through an aperture. Markings are provided at predetermined intervals on the surface of the internal case so that a user can deduce the lapsed time on the basis of the sand that has moved. The internal case is connected to an external case relative to which it can turn. The watch can include two analog or digital time displays, one for each sand container, so that at least one display is visible when the sand moves from one container to the other. There are no fluids or fluid pumps in this document. The use of sand requires a minimum size for each of the containers and channels in which the sand circulates, by reason of the granularity of the material.

A certain number of documents also describe watch mechanisms based on liquids and adapted to wristwatches.

Thus EP1947530 (Audernars Piguet Renaud & Papi S A) describes a mechanical movement for wristwatch whose winding is provided by a displacement of a liquid mass.

The liquid here performs a very specific function (the winding) but does not serve to display time indications.

EP1862873 and EP1862874 describe a display device for a watch having a transparent plate provided with a cavity connected by a channel to a colored fluid reservoir. The cavity can be filled or emptied with a micropump to display a piece of information. These plates define the watch dial, which can thus display information that varies depending on the level in the cavities. In these devices, the liquid circulates in the pipes or cavities recessed behind the glass and the dial. The reflections on the glass or in the stones that cover the dial diminish the contrast and prevent the liquid from being seen. It is thus necessary to use brightly colored liquids, which restricts the designer's aesthetic freedom. Because the cavities filled with liquid are much recessed, it is furthermore necessary to fill cavities of a relatively large size in order for the liquid to be visible. These cavities thus occupy an important place on or behind the dial, and furthermore require a powerful pump to fill them within a given time.

W02009010568 describes a wristwatch wherein a hydraulic system is used to transmit forces or torques from one point of the movement to the other, for example in order to replace the gear-train. In one embodiment, the fluid is colored and used for animations on the dial, in the movement or through the case or dial. In another embodiment, a fluid, this time transparent, circulates between two glasses in order to transmit movements in an invisible manner between two points.

GB2125991 concerns a watch having two transparent glasses, a lower one and an upper one, forming a sealed space in which a liquid as well as objects can move in order to produce a decorative effect. The liquid can be opaque. It is not used for displaying a time indication.

WO 2006/065976 concerns a system for visualizing time, wherein the passage of time is represented by the level of a fluid column. The visualization of the time indication is achieved with a conductive fluid that is pumped from one reservoir to a space between two tubes, one of which comprises a conductive layer. The capacity between this layer and the liquid, which can be controlled, is proportional to the height of the fluid. Scales are provided for reading the time on the basis of the height of the liquid. This system is not designed for a wristwatch and requires additional external means for driving the pump.

BRIEF SUMMARY OF THE INVENTION

One aim of the present invention is to propose a wristwatch enabling indications to be displayed in a new and unexpected manner.

According to the invention, these aims are achieved notably by means of a wristwatch comprising:

a housing;

a movement lodged in said housing;

a watch glass above the housing;

a fluid pump driven by said movement for pumping a fluid;

at least one channel through said glass, arranged so that the fluid circulated by said pump reaches said channel, in order to sequentially color various portions of said glass for displaying time indications.

This solution thus enables time indications or other information to be displayed directly in the watch glass. As the fluid circulates in the glass, even a light-colored fluid, or a fluid circulating in a small diameter pipe or cavity, will be highly visible. It is thus possible to display in a new manner very fine details by modifying the color of, or making opaque, portions of the glass by pumping a colored fluid in one or several channels provided for this purpose.

This solution makes it possible to display time indications directly in the watch glass instead of displaying them in or above the dial as in the prior art. The vision of the colored fluid is thus not obstructed or diminished by the reflections under the watch glass nor by hands or other elements likely to move above the dial. Furthermore, the surface of the glass, which is greater than that of the dial (at least in the case of a cambered glass) makes it possible to display more information, or the same amount of information in a larger size and closer to the user's eye.

The colored portions can correspond to large surfaces, to finer details or advantageously to one or several drops whose position along a circuit corresponds to a time indication.

According to another aspect of the invention, these aims are achieved notably by means of a wristwatch having:

a watch movement;

a fluid pump driven by said movement for pumping a fluid;

at least one channel filled with a first fluid having a first color and with a second fluid having another color, wherein the first fluid and the second fluid are immiscible, said fluid pump and said channel being arranged so as to make said fluids circulate in said channel, so that the position of the second fluid corresponds to a time indication.

This other aspect of the invention is preferably combined with the first aspect, and in this case the channel is arranged at least partly through the glass.

This other aspect of the invention can however also be independent of the first aspect and it is possible to make a channel that is not arranged through the glass, for example a channel in the dial, between the glass and the dial and/or in the movement, filled with two fluids of different color, of which one indicates a time indication.

The first fluid can for example be transparent and the second fluid colored, in order to distinguish them very clearly. In one embodiment, only one drop of the second fluid is present, whose position along the channel enables a time indication to be indicated.

In one embodiment, the watch movement is a mechanical movement. The pump can advantageously be constituted by a gear pump driven by the mechanical movement. Using a mechanical gear pump enables the pump to be miniaturized whilst ensuring sufficient performance.

The pump's carter is advantageously transparent; it is thus possible to see the mechanism and the gearings of the pump.

The watch movement can be constituted by a conventional base module and an auxiliary module that is superimposed and/or juxtaposed above the base module and driven/regulated by the latter. The hydraulic circuit assembly is mounted in or controlled by this auxiliary module, including the part of the channels that exits this module to go through the glass.

The minimum diameter of the channels is limited only by the machining options; even very fine channels, having for example of a diameter in places that is less than one millimeter or on the order of several tenths of a millimeter, will be visible when they are filled with a colored liquid. Larger channels and cavities, including channels/cavities occupying a surface of several square millimeters or even centimeters, can also be used. The channel's diameter can vary along its path.

The circulation of the fluid (which can be a mixture of two fluids, for example two liquids or one liquid and one gas) in one or several channels through the glass can be used for indicating the seconds; this allows a particularly interesting animation to be created by animating the watch glass which is usually passive with a quick movement of colored fluid. This also enables the passing of time to be represented in a particularly direct manner.

The displacement of the colored drop or portion displaying the seconds can be continuous. However, the fluid will advantageously move in a pulsed manner in one or several channels through the glass; the frequency of the pulsation s is for example one second. The use of pulsed or jerky movements makes the displacement of the fluid more visible than if it flows in a continuous fashion. Even in the case of a pulsed or discontinuous circulation, an essentially laminar flow will however be preferred in order to reduce energy losses.

The pump driving the fluid is advantageously driven by the seconds' wheel of the watch movement. The device can thus be adapted or developed from an existing movement.

The wristwatch can comprise a flexible membrane in the glass, on the dial or in the movement; this membrane can be made to move or vibrate by the fluid.

The fluid (for example the drop of the second fluid) can sequentially occupy several positions or cavities predefined in the glass in order to display consecutive time indications. It is for example thus possible to simulate the displacement of a hand or of a pointer in the glass, for example by displacing a colored drop in a continuous or jerky manner in a channel.

It is also possible to fill progressively one or several cavities in the glass with a colored fluid; the filling state can then enable a time indication to be displayed.

Surprising animations can also be achieved by modifying the shape and/or the visible surface of the drop of second fluid depending on the location it occupies hi the channel, it is for example possible to have one drop that is reduced in certain places at a poorly visible location and that is widened in other places where the channel is less deep. The speed of displacement of the drop can also vary along its path.

The channels and cavities can be machined in a monolithic glass, for example of Pyrex. In another embodiment, the glass comprises several superimposed layers and the fluid circulates at least partly in the grooves provided on the surface of two touching glasses. Advantageously, the internal glass is made of a material less hard than that of the external glass, which is for example of sapphire; in this case, the channels are advantageously provided in the glass that is less hard. The different parts of the glass can be sealed between them, by gluing or heat-sealing for example.

An anti-reflection treatment can be applied inside a cavity through said glass, for example on the surface of one of the glasses bearing against another glass. The channel is thus made particularly hard to see, in particular when it is empty. The channel's coating can also be chosen to reduce the surface's wetting, i.e. to modify the liquid's superficial tension so as to prevent it from adhering to the walls of the channels or from separating into droplets. A sufficient capillarity, so that the liquid remains in the channels even when the watch is shaken, is however necessary. A surface treatment or a coating adapted to these two contradictory requirements will thus preferably be applied on the internal surface of the channels. It is also necessary for the internal surface to remain perfectly transparent and void of any reflection, as mentioned.

The channels can be produced for example by a chemical treatment of the glass (for example by photochemical treatment), by electrochemical treatment, etc.

At least one fluid circulating in the channels is advantageously constituted by a colored liquid; the dilatation coefficient is preferably low in order to limit the risk of erroneous indications when the temperature varies greatly.

The fluid can also be two-phased and include two, or more than two, immiscible components, for example two immiscible liquids or a liquid and a gas that cannot mix. The different components are advantageously of a different color. R is possible for example to have two colored liquids, or one colored and one transparent liquid, or an emulsion. In one embodiment, a vacuum is created in the part of the channels that is not filled with liquids.

BRIEF DESCRIPTION OF THE FIGURES

Examples of execution of the invention are given in the description illustrated by the attached figures, in which.

EXAMPLE(S) OF EMBODIMENTS OF THE INVENTION

Figure 1:
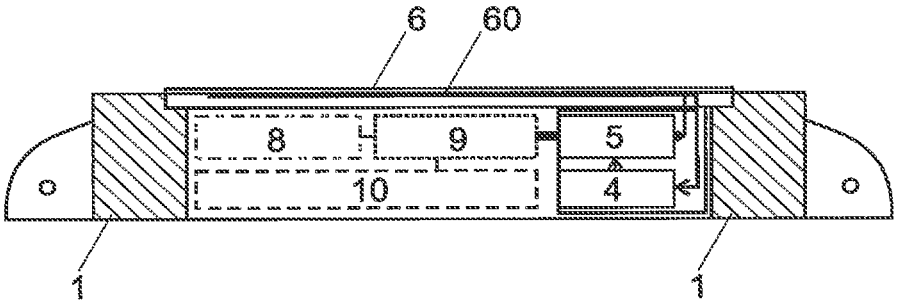
FIG. 1 illustrates a cross sectional view of a watchcase according to an embodiment of the invention.

FIG. 1 is a simplified cross sectional view of wristwatch according to the invention. Another embodiment of a wristwatch according to the invention is also illustrated in a top view in FIG. 6. The watch advantageously comprises in a case 1 a fluid distributor 2 with a reservoir 4 and a pump 5. The pump 5 is advantageously a gear pump provided with two wheels 50 with an external teething, or an inside gear pump that has lower space requirements. The gear pump is driven by the watch movement 8-9-10 which also determines its rotational speed. The carter 52 of the pump 5 is preferably transparent and can be made of synthetic material or of glass, in order to show the gears rotating and the liquid being driven. In one embodiment, the carter is made from several sheets of glass or transparent material superimposed one upon another. The sheets are preferably welded to one another and to the channels by high temperature fusion. The gearings 50 are held in this carter 52 by staffs 500 going through the carter and/or held in pivots or blind hole. One of the staffs 500 can be driven directly by a pinion or a wheel of a conventional watch movement.

Other types of pumps, for example centrifugal, peristaltic or membrane pumps, can also be used depending on the time indications to be displayed, on the fluid used and on the fluid's route. A gear pump however make it possible to use gearings that are usual components in the watch making industry and that are easier to integrate visually into a movement and to manufacture industrially.

The pump and the distributor can be visible from above or below the watch or through the sides, thus enabling the operation and the circulation path of the liquid in the watch to be visualized. In an advantageous embodiment, the pump, the reservoir and the hydraulic circuit assembly are mounted in an auxiliary module designed to be superimposed or juxtaposed to a conventional base watch movement that drives it and regulates it; it is thus possible to add a hydraulic or pneumatic display function to a conventional watch movement by superimposing the new hydraulic-display module to the base movement. For example, in FIG. 6, the pump is constituted by a transparent glass module superimposed over an existing watch movement and geared by one of the staffs 500 of this movement, for example by the staff of the seconds' wheel that drives one of the two gearings of the pump either directly or through an intermediate wheel. The pump 5 is then located between the movement and the glass; it is driven from below by a staff 500 and connected above to the channels 60 in order to transport one or several drops of liquid in the channels.

The watch movement comprises an energy supply 8, for example a barrel or a battery, a regulating component 10, for example a balance/spiral assembly or a quartz oscillator, as well as transmission elements 9, including for example a gear and pinion train. Other elements, including complications etc., can be provided. The energy source 8 also enables the pump 5 to be actuated.

The pump 5 drives the liquid coming from the reservoir 4 in one or several channels 60 going through the watch glass 6 so as to display time indications or other indications directly in the glass. The channels typically include display portion s parallel to the surface of the glass as well as borings 64 perpendicular to this surface and enabling them to be connected to the pump and to the distributor in the movement.

The geometry and the dimensions of the channels in the glass and in the remainder of the watch are chosen so as to enable a bubble-free filling when bubbles are not desired. To this effect, the minimum sections of the channels are on the order of the square millimeter, for example between 0.1 and 10 square millimeters, which allows bubbles to escape with surge pressures that are acceptable by the system, for example overpressures of several millibars only. Furthermore, it would be preferable to avoid changes of direction that are too sudden, for example right angles, and complex or too-fine geometries that are likely to cause bubble obstructions in the narrow passages and to block the flow of the fluid.

As indicated, it is also possible to make channels that do not go through the glass and that are filled with two immiscible fluids, of which one indicates by its position a time indication.

The liquid (or another fluid) is preferably colored so as to be better visible in the channels; transparent liquids can however also be used if they modify the refraction on the internal surface of the channels so as to render them visible when they are full. The circulation of the liquid through these channels thus enables the opacity and/or the color of the glass to be modified at the places where the channels pass, depending on the position of the liquid in these channels. It is also possible to use phosphorescent liquids visible in the dark, for example fluids loaded with phosphorescent or luminescent particles.

The path travelled by the channels in the glass can include forks in order to selectively fill different channels or cavities in the glass. The indications displayed will then depend on the channels I cavities that are filled at each moment. In the preferred embodiment of FIG. 6, the circuit includes a single channel 60 in a closed loop, wherein one or several drops or bubbles of fluid circulate and whose position supplies a time indication. In a preferred embodiment, the position of the drop 65 corresponds to a seconds' cursor and is incremented by 6° every second; the displacement of the drop can occur in a regular and continuous fashion or by jerks every second.

It is also possible to use several segments of colored liquid, whose position in the channel allows an indication to be displayed. These two solutions can furthermore be combined in order to display indications by means of drops, bubbles or segments of colored liquid that selectively travel one path from among different possible paths. It is also possible to display indications by means of bubbles of gas or light fluid rising through another liquid, wherein the boundary line between the gas and the other liquid serving to display an indication.

If the channel in the glass or in the movement includes forks, the watch can include micro-valves in order to control the path chosen by the liquid at each instant. These micro-valves can also be mounted in the glass. They are however difficult to hide and furthermore have the disadvantage of easily getting blocked, for example because of bubbles or impurities.

Alternatively, or additionally, it is also possible to use several pumps controlled independently from one another in order to selectively send a liquid into one channel or another. For example, a channel can transport a first drop of liquid displaying the current second, whilst a second channel can transport another drop displaying another indication, for example the second of the chronograph. Each liquid channel or circuit can have its own pump; depending on the indications, a single pump can also drive drops in several circuits.

It is also possible to use passive micro-valves, i.e. without moving parts, and/or micro-diodes, for example micro-diodes of the Tesla type, convergent-divergent type or Vortex type, which enable the flow of a fluid to be regulated and controlled in a reliable and reproducible manner in time.

In an advantageous embodiment, the path taken by the fluid will depend on the fluid's viscosity, on the internal walls of the channel and on the pressure applied by the pump. It is thus possible to control the traveled path and/or the flow rate of a bubble or a drop in the channels by performing a suitable choice as regards the surface tensions of the liquids and the wetting properties and hydrophilic or hydrophobic characteristics of the channels' surfaces, their shape and their surface state. Preferably, no active micro-valve is used in the liquid circuit.

Figure 2:
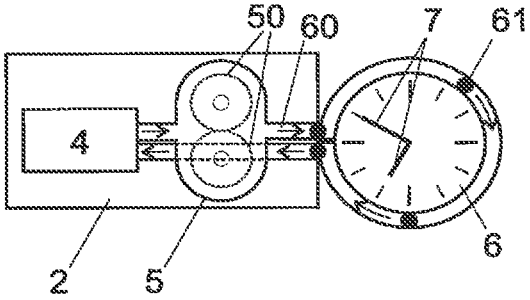
FIG. 2 is a block diagram of a wristwatch according to an embodiment of the invention.
Figure 6:
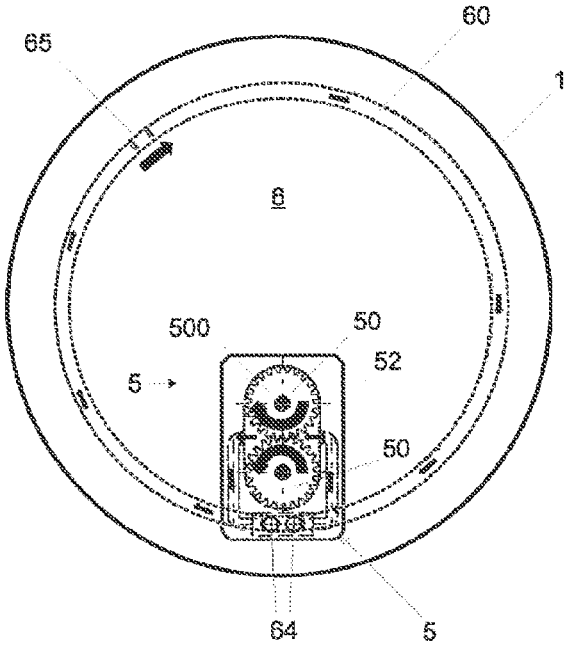
FIG. 6 is a view from above of a watch having a micropump and a hydraulic second.

In the example of FIG. 2 and in that of FIG. 6, a drop 65 of a second fluid travels a ring path at the periphery of the glass, so as to simulate the displacement of a colored seconds pointer in the glass. The liquid drop preferably has a high viscosity so as to not split even when the watch is shaken; it is pushed in the ring channel by a first fluid of a different color, for example a gas or a second transparent liquid that will not mix with the liquid of the drop, and caused to move by the micropump. The viscosity and/or the color of the two fluids are different and they are immiscible. Cavities 61 can be provided in this ring path, for example 60 successive cavities mutually spaced at a distance of 6" to one another; the drop moves from one cavity to the next at each second, under the impulsion of the pump which can be actuated in a pulsed manner. The diameter and the shape of the cavity can be different respectively from the diameter and/or the shape of the channel between the cavities so as to force the drop to stop in these cavities. It is also possible to apply to the inside surface of the cavities a micro-structuration or another surface treatment different to that applied to the channels in order to help the drop to progress in a discrete and indexed manner from one cavity to another. As mentioned here above, this display of the seconds by a drop, as described in this paragraph, can also be used with a channel that does not go through the glass.

The representation of the passing of time can also be achieved by a tourbillon movement of the fluid in the watch glass or by a laminar movement in a path whose shape recalls a tourbillon or another decorative figurative or abstract shape. Cavities of different shapes and volumes then follow each other in succession until the fluid returns to the distributor. It is also possible to use a circular channel that winds on itself with a flow rate that accelerates towards the center of the representation until it reaches an evacuation channel close to the center of the glass. The acceleration and slowing of the fluid can be made visible by bubbles, drops or non-homogenous mixtures of fluids.

Figure 7:
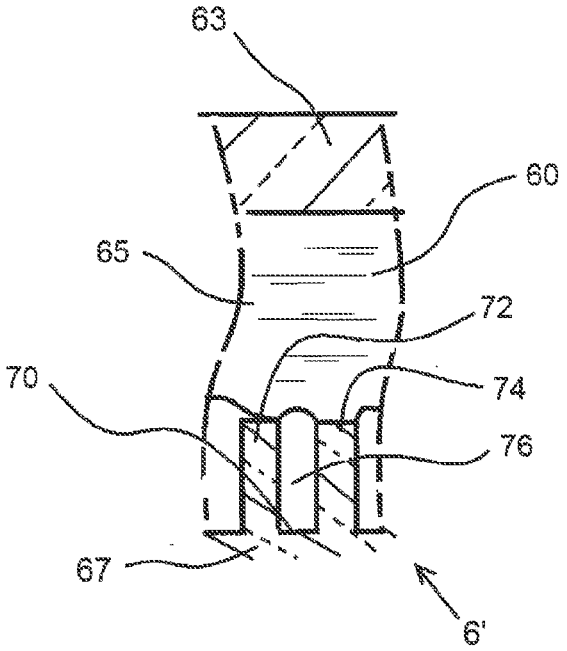
FIG. 7 is a partial, cross-sectional view of an alternate embodiment of the invention.

Referring now to FIG. 7, the choice of an appropriate texture on the inside surface 70 of the channels 60 in the watch glass 6' allows the contact surface of a drop with this surface to be modified. For example, by applying points—for example protuberances such as carbon or glass nanotubes 72—on the inside walls of the channels 60, the wetting can be considerably reduced and an extremely hydrophobic channel will be obtained. This is sometimes called the "fakir" effect; the drops that cannot slide between the peaks 74 of the roughness tend to settle on the peaks rather than to wet the portions 76 of surface between these peaks. The contact surface between the liquid of the drop 65 and the channel 60 is thus considerably reduced, which makes the flowing easier, reduces friction and reduces the energy required to make the liquid progress. Appropriate selections of structures at different places on the liquid's path further allow the flow rate and the path of one or the different fluids to be controlled. It is also possible to use these microstructures such as these nanotubes 72 for creating large-surface cavities in which the liquid advances very quickly and with a reduced friction, which enables them to be filled and emptied nearly instantaneously.

Other animations, including the simulation of hands rotating inside the glass, can be used. It is for example also possible to move drops in a continuous and progressive manner or to make several drops advance simultaneously or at different speeds in different channels. Furthermore, it is possible to use channels of variable diameter and section along the channel so as to modify the flow rate and/or the surface of the drop visible to the user. For example, it is possible to transform a highly concentrated drop by spreading it over a large surface and then to make it take up a more compact form again in order to create surprising animations in the glass. In another embodiment, it is possible to combine several drops, for example by pouring at each second or at regular intervals one drop in a reservoir whose fill state will indicate the number of seconds of the current minute, then to separate the liquid of this reservoir into 60 drops at the end of the minute or during the subsequent minute. Other flow rates can be used. Micro dosing devices can be used to separate a volume of liquid into smaller quantities.

Figure 3:
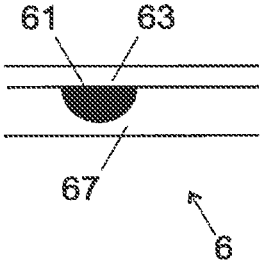
FIG. 3 is a cross sectional view of a detail of the watch glass according to the invention.

FIG. 3 illustrates a cross sectional view of a portion of the glass 6 comprising an outer glass 63 made of a hard material and an inner glass 67 made of a material that is easier to machine or engrave. A channel or a cavity 61 is etched in this lower layer and selectively filled with colored liquid through the pumping action of the pump 5. The different parts of layers of the glass can be sealed hermetically to one another, for example by thermal or chemical gluing. Micro-borings in the lower part 67 enable the liquid to pass through to feed the channels.

The distributor 2 enables the connection between the channels of the glass and the other elements in the movement where the liquid circulates to be connected. The distributor can also be made in several parts assembled tightly and comprise channels and openings for distributing the liquid. Flexible or rigid micro-pipes can also be used.

The micro-machining of hard and transparent materials can also be made by methods such as:

- mechanical: diamond tool, sandblasting, abrasive water jet, ultrasound with or without abrasive
- chemical: photoengraving, wet etching, dry etching
- electro-thermal: laser electrochemical: electric discharge machining (EDM) assisted by chemical erosion The method used for machining the hard, fragile and transparent parts is selected to guarantee a good surface state, i.e. with a low roughness in order to preserve the transparency of the materials after machining. Using several combined technologies for a hole and/or for a part makes it possible to achieve the required feasibilities and manufacture qualities of the micromachining. For the micro-channels and micro-cavities, chemical processes will advantageously be chosen whilst for micro-boring, electrochemical methods for example will tend to be chosen as they will enable a depth/diameter ratio greater than 10, and thus a better quality in the shape and repeatability of the micro-borings, to be achieved. Whenever the transparency of the materials is not a necessary condition, such as for the distributor or for other hidden elements, laser machining and post-processing of the "enlarging" or "buffing" type can be used.

As mentioned, the channels, cavities and grooves can furthermore benefit from a surface treatment (micro-structuration) or a surface coating in order notably to reduce reflections, to control their wettability with the fluid, to reduce the frictions of the fluid onto the walls and/or to ensure a non-turbulent flow.

The carter of the pump 5 is also advantageously made by chemical or electrochemical machining. The tightness of the driving staff 50 can be ensured by a joint, not represented.

The liquid reservoir 4 (optional) can be integrated into the distributor and/or be lodged in the crown, in the bezel or in the housing of the watch.

The connections between the different channels and feed openings are preferably made without joints in order to facilitate the assembly and avoid tightness problems. For example, the connection between the channels of the glass and the tubes or channels of the movement can be made by carefully aligning the glass with the case—preferably by means of a mechanical stop, a pin etc. so as to make the open extremities of channels accurately match the open extremities of channels in the glass and in the case or the movement. Tightness is then achieved by gluing, for example ultraviolet gluing, or by thermal fusion ("fusion bonding") of the two juxtaposed channels.

Figure 4:
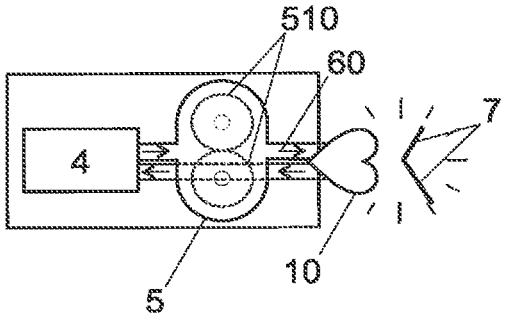
FIG. 4 is a block diagram of a wristwatch according to another embodiment of the invention.
Figure 5:
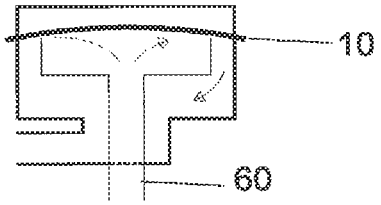
FIG. 5 is a cross sectional view of a display device having a flexible membrane actuated by a fluid.

FIG. 4 illustrates another embodiment in which a cavity in the watch glass or in the movement is filled with or emptied of a liquid in a pulsed manner, so as to beat the seconds. This cavity can be covered with a membrane 10 represented in cross section in FIG. 5; the pulsing of the liquid in the channel behind the membrane 10 makes the latter vibrate or pulsate in a particularly visible manner. The membrane can be colored and/or be provided with a decorative shape and design, for example a heart in FIG. 5. Several membranes vibrating in a synchronous or phase-shifted manner in the same watch can be used.

The liquid can also be used for other representation s, for example for displaying in the glass complications of the type deadbeat seconds, jumping seconds, chronograph seconds etc. The seconds' display is advantageous since time setting and of the placement of the drop of colored liquid at the correct place along its trajectory is less of a problem. It is however also possible to use this hydraulic solution for displaying other indications corresponding to longer durations, for example minutes, hours, dates etc. Time setting means by manually displacing the drop by manual pumping must then advantageously be implemented; these manual pumping means can simply use the conventional time setting circuit, which actuates the pump to move the drop.

Using a liquid is also advantageous for displaying indications like countdown, for example regatta countdown, or for displaying tides etc.

In one advantageous embodiment, the watch enables a measured duration, for example a chronograph second, to be displayed. It is also possible to make an inking chronograph in which a measured duration is displayed by deposition of a drop of liquid at the beginning of the duration and of a second drop at the end of the measured lapse of time.

It is also possible to have several channels that are superimposed or that cross at different levels in the glass in order to display complex indications or to modify the color in the superimposition zones.

It is also possible to use polarized watch glasses or layers in the glass; the circulating liquid can modify the direction of polarization in the channel in order to achieve considerable color or opacity changes.

The present invention also relates to additional modules designed to be superimposed or combined above a conventional watch movement and to work with such a conventional watch movement for displaying a time indication by means of a fluid circulating in a channel through the glass and/or by means of a drop of a second fluid circulating in a channel filled by a first fluid for displaying a time indication.

The invention claimed is:

1. An indicator comprising:

a housing;

a movement lodged in said housing;

a watch glass above the housing;

a fluid pump driven by said movement for pumping a fluid; and at least one channel arranged so that the fluid circulated by said pump reaches said channel in order to fill said channel for displaying indications wherein the circulation of the fluid in said channel serves to indicate seconds.

2. The indicator of claim 1, wherein said movement is a mechanical movement, said pump being a gear pump driven by the movement.

3. The indicator of claim 2, wherein the pump has a housing and the pump's housing is transparent.

4. The indicator of claim 1, wherein the diameter of said channel in at least one place being less than 1 millimeter.

5. The indicator of claim 1, wherein the fluid moves in a pulsed manner in said channel, with the pulse frequency being one second.

6. The indicator of claim 1, comprising a flexible membrane made to pulse by said fluid.

7. The indicator of claim 1, wherein a fluid segment occupies several predefined positions in succession in order to display consecutive indications.

8. The indicator of claim 1, wherein at least one drop of liquid colored differently from another fluid in the same channel is moved in the channel, said drop being immiscible into said other fluid.

9. The indicator of claim 8, wherein said drop progresses in an indexed manner in said channel.

10. The indicator of claim 9, wherein said drop moves in a jerky manner from one cavity to another in said channel.

11. The indicator of claim 1, wherein the inner surface of one of the channels is covered with protuberances designed to reduce the contact surface between the liquid and the channel.

12. The indicator of claim 1, comprising a cavity filled progressively by said fluid, the fill state enabling an indication to be displayed.

13. The indicator of claim 1, comprising a micro-diode of the Tesla type, convergent-divergent type or Vortex type.

14. The indicator of claim 1, wherein the path taken by the fluid and the speed of the fluid depend only on the fluid's viscosity, on the internal walls of the channel and on the pressure applied by the pump, without being controlled by mechanical elements other than the pump.

15. The indicator of claim 1, said glass being of two parts, an inner part with a first hardness, being provided with said channel, and an outer part with a second hardness greater than the first hardness.

16. The indicator of claim 1, wherein said glass has boring holes for connecting said channels to the remainder of the indicator, and wherein sealing between the extremity of said borings and the hydraulic path into the indicator is ensured by thermal or chemical gluing.

17. The indicator of claim 1, having a treatment inside a channel or cavity in order to control the surface tension of the liquid.

18. The indicator of claim 1, wherein one said channel is produced by chemical or electrochemical treatment of the glass.

19. The indicator of claim 1, wherein said fluid comprises two immiscible components.

20. The indicator of claim 19, wherein the two said components have a different color or viscosity.

21. The indicator of claim 1, wherein the indicator is a wristwatch.

22. The indicator of claim 1, wherein the indications are time indications.

23. An indicator comprising:

a housing;

a movement lodged in said housing;

a watch glass above the housing;

a fluid pump driven by said movement for pumping a fluid; and at least one channel arranged so that the fluid circulated by said pump reaches said channel in order to fill said channel for displaying indications, wherein the fluid flows at visibly different speeds in various places of the channel.

24. An indicator comprising:

a housing;

a movement lodged in said housing;

a watch glass above the housing;

a fluid pump driven by said movement for pumping a fluid; and at least one channel arranged so that the fluid circulated by said pump reaches said channel in order to fill said channel for displaying indications, the indicator having an anti-reflection treatment applied inside one channel or cavity.

* * * * *